US006749538B2

(12) United States Patent
Slawinski et al.

(10) Patent No.: US 6,749,538 B2
(45) Date of Patent: Jun. 15, 2004

(54) INTERLOCK APPARATUS FOR FITNESS EQUIPMENT

(75) Inventors: Michael D. Slawinski, 1601 Wickersham Pl., Suwanee, GA (US) 30024; Phillip R. Wills, Roswell, GA (US); Henrik B. Christophersen, Smyrna, GA (US)

(73) Assignee: Michael D. Slawinski, Suwanee, GA (US)

( * ) Notice: Subject to any disclaimer, the term of this patent is extended or adjusted under 35 U.S.C. 154(b) by 496 days.

(21) Appl. No.: 09/746,184

(22) Filed: Dec. 19, 2000

(65) Prior Publication Data

US 2002/0077224 A1 Jun. 20, 2002

(51) Int. Cl.[7] ..... A61B 5/103

(52) U.S. Cl. ..... 482/44; 482/49; 482/8; 482/900

(58) Field of Search ..... 482/1–9, 44–49, 482/91–93, 900–902; 601/23, 33, 40

(56) References Cited

U.S. PATENT DOCUMENTS 4,998,721 A 3/1991 Anders et al.
5,484,355 A * 1/1996 King et al. ..... 482/4
5,904,639 A * 5/1999 Smyser et al. ..... 482/91
6,149,550 A * 11/2000 Shteingold ..... 482/8

OTHER PUBLICATIONS

U.S. patent application Ser. No. 09/201,434, Slawinski et al., filed Nov. 30, 1998.

U.S. patent application Ser. No. 09/385,241, Slawinski et al., filed Aug. 28, 1999.

* cited by examiner

*Primary Examiner*—Glenn E. Richman
(74) *Attorney, Agent, or Firm*—Kenneth S. Watkins, Jr.

(57) ABSTRACT

Interlock apparatus for fitness equipment comprises a microprocessor 105 receiving grip signal inputs from grip sensors (101A, 101B) mounted on a load-bearing component of the fitness equipment. Signal conditioners (103A, 103B) provide noise filtering, signal debouncing and digital inputs for the microprocessor. Grips status monitors (106A, 106B) provide grip status signals used by microprocessor 105 to determine the validity of the grip signals. Microprocessor 105 provides validity criteria which changes depending on the grip status inputs. The apparatus detects sensor connection changes and abnormal sensor and circuit operation and modifies logic functions to improve the capability and reliability of safety locks and brakes on the equipment.

30 Claims, 6 Drawing Sheets

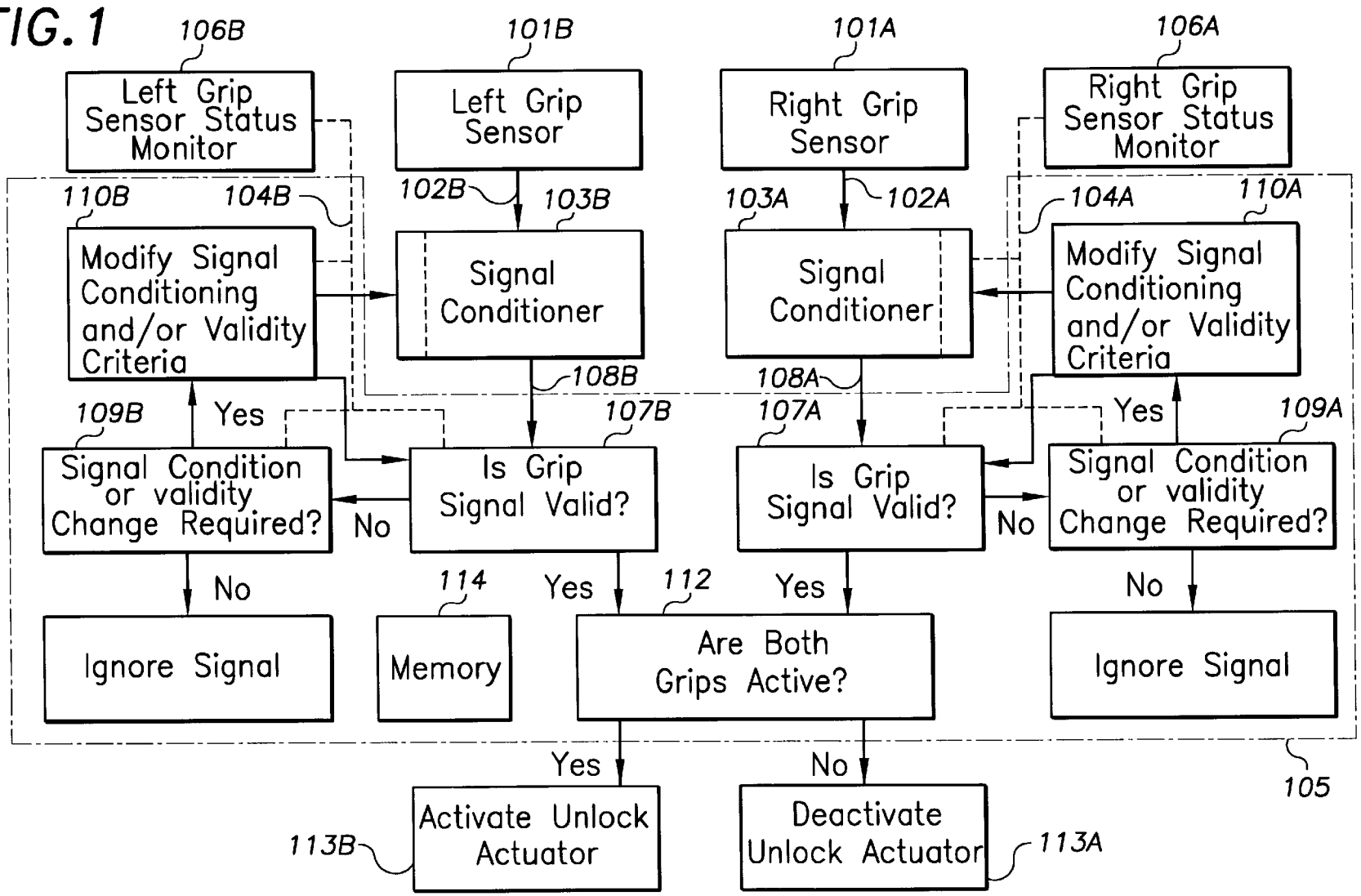
FIG. 1
106A
Right Grip Sensor Status Monitor
110A
Modify Signal Conditioning and/or Validity Criteria
109A
Signal Condition or validity Change Required?
Ignore Signal
105
104A
Yes
No
101A
Right Grip Sensor
102A
Signal Conditioner
103A
108A
107A
Is Grip Signal Valid?
Yes
No
Are Both Grips Active?
112
Deactivate Unlock Actuator
113A
101B
Left Grip Sensor
102B
103B
Signal Conditioner
108B
107B
Is Grip Signal Valid?
Yes
No
114
Memory
Yes
Activate Unlock Actuator
113B
106B
Left Grip Sensor Status Monitor
104B
110B
Modify Signal Conditioning and/or Validity Criteria
109B
Signal Condition or validity Change Required?
Yes
No
Ignore Signal

INTERLOCK APPARATUS FOR FITNESS EQUIPMENT

FIELD OF THE INVENTION

The present invention relates to fitness equipment and, more particularly, to interlock apparatus for actuating safety locks on fitness equipment.

BACKGROUND OF THE INVENTION

Safety features such as brakes or locks on load-bearing components of fitness and exercise equipment are often important to reduce the chance of personnel injury or equipment damage. By example, U.S. application Ser. Nos. 09/201,434 and 09/385,241 disclose self-spotting apparatus for free-weights having pressure-sensitive grip actuators on the barbells and dumbbells that lock support cables if either grip actuator is released. U.S. Pat. No. 4,998,721 discloses a weightlifter's exercising apparatus having a brake means discretionally controlled by the athlete at the handgrip positions.

While such grip actuators provide desired convenience or safety functions in many cases, conditions arise in which added capabilities to sense abnormal conditions, either in the apparatus or use of the apparatus is needed. For example, connection or re-connection of sensors, which may be required when changing from barbells to dumbbells in fitness equipment, can result in reduced effectiveness of the safety features, convenience features or interlocks. Environmental changes can result in circuit drift, especially if the sensors are analog devices.

OBJECTS AND SUMMARY OF THE INVENTION

Therefore, an object of the present invention is to provide interlock apparatus for fitness equipment which actuates safety features such as safety locks or brakes when an operator is not adequately gripping load-bearing components of the equipment.

Another object of the present invention is to provide interlock apparatus for fitness equipment which senses abnormal operation of the equipment and maintains the equipment in a safe mode.

Another object of the present invention is to provide interlock apparatus for fitness equipment which senses disconnection of grip sensors of the apparatus and modifies the signal verification logic to maintain safe operation upon re-connection of the grip sensors.

Another object of the present invention is to provide interlock apparatus for fitness equipment which provides reliable safety interlock operation when disconnecting and re-connecting different load-bearing components.

Still another object of the present invention is to provide sensors which utilize capacitance or inductance of the body to provide g rip signals, thereby eliminating mechanical switches and providing additional data for use by a logic processor.

The interlock apparatus of the present invention utilizes one or more engagement or grip sensors attached to user-engageable load-bearing components of fitness equipment such as self-spotting free-weight bars, dumbbell bars, fitness equipment lift bars, curl bars, foot pedals, etc. The interlock apparatus provides grip signal validity checks to ensure that safety features such as brakes or locks are activated when required and makes the apparatus less prone to inadvertent activation by invalid signals. The interlock apparatus goes beyond simple "on-off" pressure witches such as micro switches by providing "smart" features that ensure activation signals are valid operator-actuated signals.

In the preferred embodiments, the interlock apparatus comprises a grip sensor such as a capacitance sensor that senses the capacitance of the body when the operator makes touch contact when gripping the load-bearing component in the proper manner. The grip sensor is connected to a logic processor having a memory, such as a microprocessor, through a signal conditioner. The signal conditioner provides a digital output for processing by the logic processor, noise filtering and de-bouncing of the signal from the grip sensor.

In the preferred embodiments, the signal conditioner also provides a grip status signal to the logic processor for determining the validity of the grip signal. In the preferred embodiments, the grip status signal is a digital pulse signal proportional to the amplitude of the grip signal from the grip sensor. In other embodiments, the grip status signal comprises a signal corresponding to a cardiovascular or heart pulse signal. In still other embodiments, the grip status signal is a continuity signal from a separate grip sensor continuity sensor or circuit. The grip status signal may be multiplexed or otherwise combined with the grip sensor signal output of the signal conditioner connected to the microprocessor. In other embodiments a separate grip sensor status monitor provides the sensor status signal.

The microprocessor utilizes a first predetermined validity criteria to provide an interlock function based on receipt of a grip signal. In the simplest case, receipt of an "active" signal from the grip sensor when the sensor status signal meets a predetermined grip status range satisfies the first validity criteria. Upon a change in the grip status signal, resulting in the sensor status signal not meeting the predetermined grip status range, the microprocessor provides a second predetermined validity criteria which is different from the first validity criteria.

The second validity criteria provides the ability of the logic processor to compensate for known or suspected conditions detected in the grip status signal. For example, the microprocessor may ignore a subsequent "active" grip signal after a changed grip status signal which indicates disconnection of the sensor, even if the grip status signal returns to the predetermined range, since the subsequent "active" grip signal may be due to reconnection of the grip sensor. In this case, the second validity criteria of the microprocessor evaluates the subsequent "active" grip signal as invalid, even if the status signal is in an otherwise valid range.

Many other validity criteria may be employed by the logic processor to correct anticipated problems detectable by the grip status signal. For example, the logic processor may ignore any "active" grip signals that, upon processing of the grip status signal by the microprocessor, indicate a changing or insufficient contact or grip on the grip sensor. Or, the logic processor may ignore otherwise "active" grip signals upon loss of a cardiovascular or heart pulse signal detected by the grip sensor or separate pulse sensor. In still another embodiment, a signal duration requirement of the first validity criteria may be changed upon a change in the grip status signal.

In the preferred embodiments the logic processor also provides signal conditioning changes upon receipt of a change in the grip signal status in order to enhance the operation of the interlock apparatus. For example, upon receipt of a changed grip status signal indicating a disconnection in the grip sensor, the signal conditioner may be "reset" or "recalibrated" by the logic processor when a subsequent change in the grip status signal indicates the sensor has been re-connected. In this way, future "active" grip signals will be properly evaluated as "active" signals by the apparatus.

In a preferred embodiment of the invention, an analog grip sensor is utilized to provide an output proportional to a gripping action. In the preferred embodiments, a field-sensitive sensor, such as a capacitance sensor or an inductance sensor is used. Such a sensor, attached to a load-bearing component of fitness equipment such as a barbell bar, utilizes a capacitance or inductance field established between a part of the body and the sensor to provide the grip sensor signal. Such a field-sensitive sensor does not require a mechanical action of the sensor, such as that required by a mechanical switch. The output of such a sensor is proportional to closeness of the body portion to the sensor or, more preferably, the contact made with the sensor. Such an output can be used by the grip sensor status monitor to determine the validity criteria of the device.

Such a field-sensitive sensor also has the advantage of requiring only a single electrical conductor to couple the sensor to a logic processor through a signal processor or conditioner. In the preferred embodiments, a cable supporting the load-bearing component of the fitness equipment provides the electrical connection between the field-sensitive sensor and the signal processing portions remotely located on the fitness equipment.

BRIEF DESCRIPTION OF THE DRAWINGS

These and other features, aspects and advantages of the present invention will become better understood with regard to the following description, appended claims and accompanying drawings where:

FIG. 1 is a logic diagram of the logic processor of the present invention showing grip sensor inputs, grip sensor status monitor inputs, and grip signal validity change loops within the processor;

DESCRIPTION OF THE PREFERRED EMBODIMENTS

Figure 2:
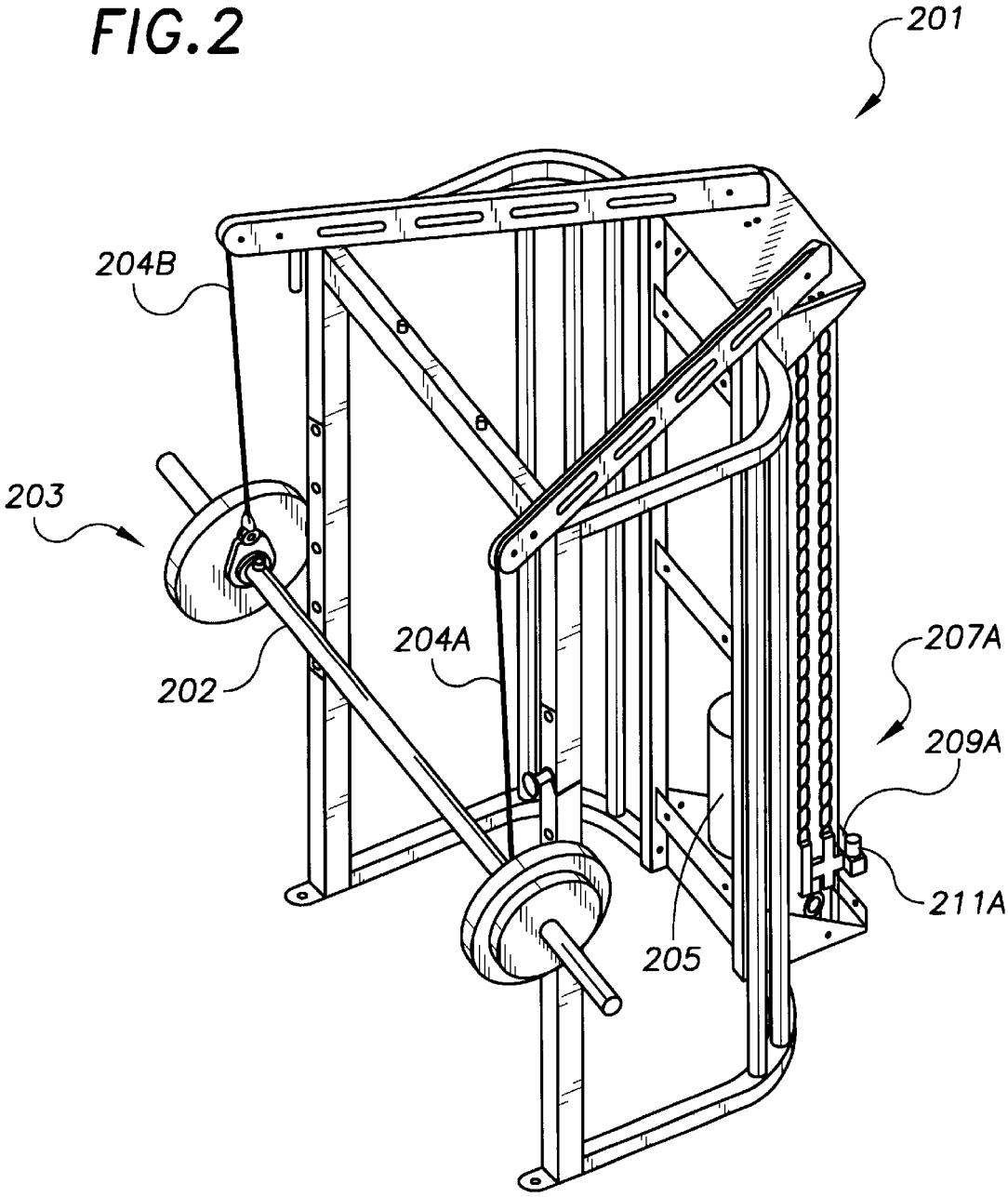
FIG. 2 is a perspective view of free-weight spotting equipment having grip sensors on the barbell and a locking mechanism responsive to the grip sensors.

The following is a description of the preferred embodiments of interlock apparatus that provides flexible "smart" logic features for improving the performance of fitness equipment.

FIG. 1 is a logic diagram of a grip sensor apparatus for exercise equipment utilizing two hand grips such as a free-weight spotting apparatus disclosed in related patent applications Ser. Nos. 09/201,434 and 09/385,241, hereby incorporated as references. In such equipment, grip sensor apparatus performs important safety functions such as locking cables attached to the free-weights to prevent the weights from falling unless the free-weight is securely gripped by the user.

In the preferred embodiments, the right grip sensor 101A and left grip sensor 101B are touch sensors such as capacitance sensors, although in other embodiments, other sensors such as inductance sensors, conductance sensors, hall-effect sensors, conductance sensors, etc. could be used. In the preferred embodiments, signal conditioners 103A and 103B provide noise filtering of the signal emitted by grip sensors 101A and 101B and provide a first state or "active" signal when the grip sensor is gripped by a user and a second state or "inactive" signal when the grip sensor is not gripped by a user. In other embodiments, signal conditioners 103A and 103B provide "debouncing" of the signal to ensure that only signals of a predetermined duration are passed by the signal conditioner.

In the preferred embodiments, signal conditioners 103A and 103B also provide a grip sensor "status" monitoring function which provides a separate sensor status signal 104A and 104B to a logic processor such as microprocessor 105. In the preferred embodiments, sensor status signals 104A and 104B are related to the amplitude of sensor signals from grip sensors 101A and 101B and provide a signal for microprocessor 105 to determine the validity of sensor 101A and 101B active or inactive signals. In other embodiments, the sensor status signal may be provided by a separate grip sensor status monitor such as right grip sensor status monitors 106A and 106B.

The signal conditioners 103A and 103B may also provide circuitry to set a quiescent or base point for signal comparison upon powering up of the circuitry and to compensate for sensor drift caused by environmental changes. In a preferred embodiment, signal conditioners 103A and 103B are analog to digital (A/D) converters, changing the analog signals from grip sensors 101A and 101B to digital signals for processing by microprocessor 105.

Microprocessor 105 comprises software programming to perform validity tests and closed loop signal conditioning modification and/or validity criteria modification in order to provide convenience features or to improve the reliability of grip sensors in performing safety functions in fitness equipment. This is especially useful when the grip sensors are analog sensors, such as capacitance, conductance or inductance sensors that are subject to drift and variances due to environmental changes. Changing exercise equipment components, such as from barbell to dumbbells in the examples shown in this specification, also result in electrical connection changes which could prevent erroneous protective actions or lack of valid protective actions.

In the following description, processing of signals from the right grip sensor 101A and associated circuitry are explained, although it is understood that processing of left grip sensor 101B signals is similar.

The signal validity logic loop of the present invention comprises the steps of evaluating the grip status signal from grip sensor 101A through signal conditioner 103A, or alternatively, from right grip sensor status monitor 106A against predetermined signal status ranges or validity criteria in steps 107A and 109A. In the preferred embodiment, the status signal validity criteria includes a requirement that sensor status signal 104A be of a value indicating that grip sensor 101A is connected and the sensor signal is in a normal range. In the preferred embodiments, this is done in logic step 107A by comparing signal 104A, which indicates the amplitude of sensor 101A signal against predetermined validity ranges stored in the memory 114 of microprocessor 105, to determine whether the grip sensor is connected electrically and if the associated sensor 101A and signal conditioner 103A circuitry is operating normally.

In the preferred embodiment, microprocessor 105 utilizes the status signal 104A to detect abnormal conditions such as those occurring if connections to the sensors are interrupted or re-connected. This is accomplished by comparing status signal 104A against predetermined identification criteria in the memory of the microprocessor. When a status signal is present indicating an abnormal occurrence, either the signal conditioning of signal conditioner 103A or validity criteria of step 107A may be changed in logic step 109A and 110A by microprocessor 105 in order to enhance the reliability of the safety features and perform the desired logic processing.

For example, if grip status signal 104A changes to a value determined by microprocessor 105 to be a sensor 101A disconnection, the grip signal validity criteria may be changed to ignore the next "active" grip signal, since the next "active" grip signal may be due to the re-connection of the sensor. In addition, signal conditioner 103A may be "reset" after microprocessor 105 detects the reconnection to "recalibrate" the signal conditioner and provide a valid activation signal at step 107A the next time sensor 101A is gripped. If grip status signal 104A changes to a value indicating a circuit fault that might produce an invalid "active" grip signal, microprocessor 105 may change the grip validity criteria to ignore subsequent signals.

Sensor status signal 104A may be supplied from an internal or external sensor sensing connection or disconnection of grip sensor 101A by grip signal amplitude, absence or presence of a cardiovascular or heart pulse, frequency analysis or continuity of grip sensor circuitry. Grip status signal 104A may be multiplexed or otherwise combined with grip signal 102A or 108A or it may be a separate signal supplied to microprocessor 105.

Logic step 112, performed by microprocessor 105, utilizes input from logic steps 107A and 107B and a predetermined selection criteria to determine if both grips have supplied valid "active" signals. In the preferred embodiment of the present invention, active and valid grip signals from both logic steps 107A and 107B are required to activate unlock actuators in step 113B. If only one, or no, active and valid grip signals are received in logic step 112, unlock actuators remain deactivated in step 113A. In other embodiments, a single valid grip signal will allow activation of an unlock actuator, such as an unlock actuator for a single side of the equipment.

EXAMPLE

FIG. 2 is a perspective drawing of an embodiment of the present invention for fitness equipment such as free-weight spotting apparatus 201. Bar 202 of barbell 203 is supported by cables 204A and 204B of apparatus 201. Cables 204A and 204B are supported and moved by a positioner 205 acting through weight support assemblies (only right side weight support assembly 207A is shown for clarity). Weight support assembly 207A comprises a locking or engagement block 209A which selectively allows connection of cable 204A to weight support assembly 207A. Solenoid and spring assembly 211A of block 209A acts as the unlock actuator of steps 113A and 113B of FIG. 1. Cable 204B is supported in a similar manner.

Figure 3:
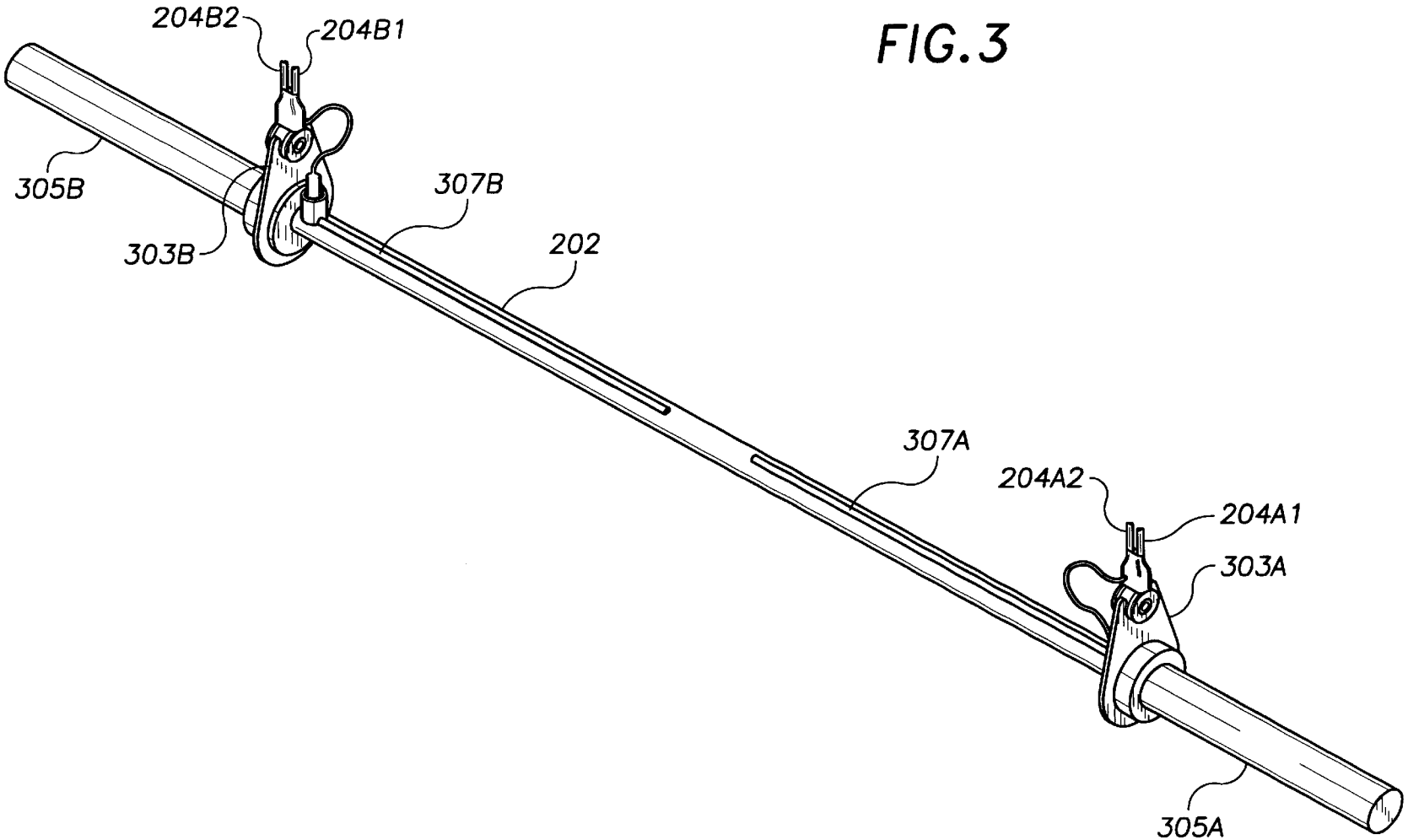
FIG. 3 is a perspective drawing of the barbell of the spotting equipment of FIG. 1 showing the positioning of the grip sensors.

FIG. 3 is a perspective drawing of barbell bar 202 of barbell 203 of FIG. 1 showing cable attachment assembly 303A attaching cables 204A1 and 204A2 to barbell end 305A and cable attachment assembly 303B attaching cables 204B1 and 204B2 to barbell end 305B. Grip rods or sensors 307A and 307B act as touch sensors for the touch sensor apparatus discussed in the following figures.

Figure 4:
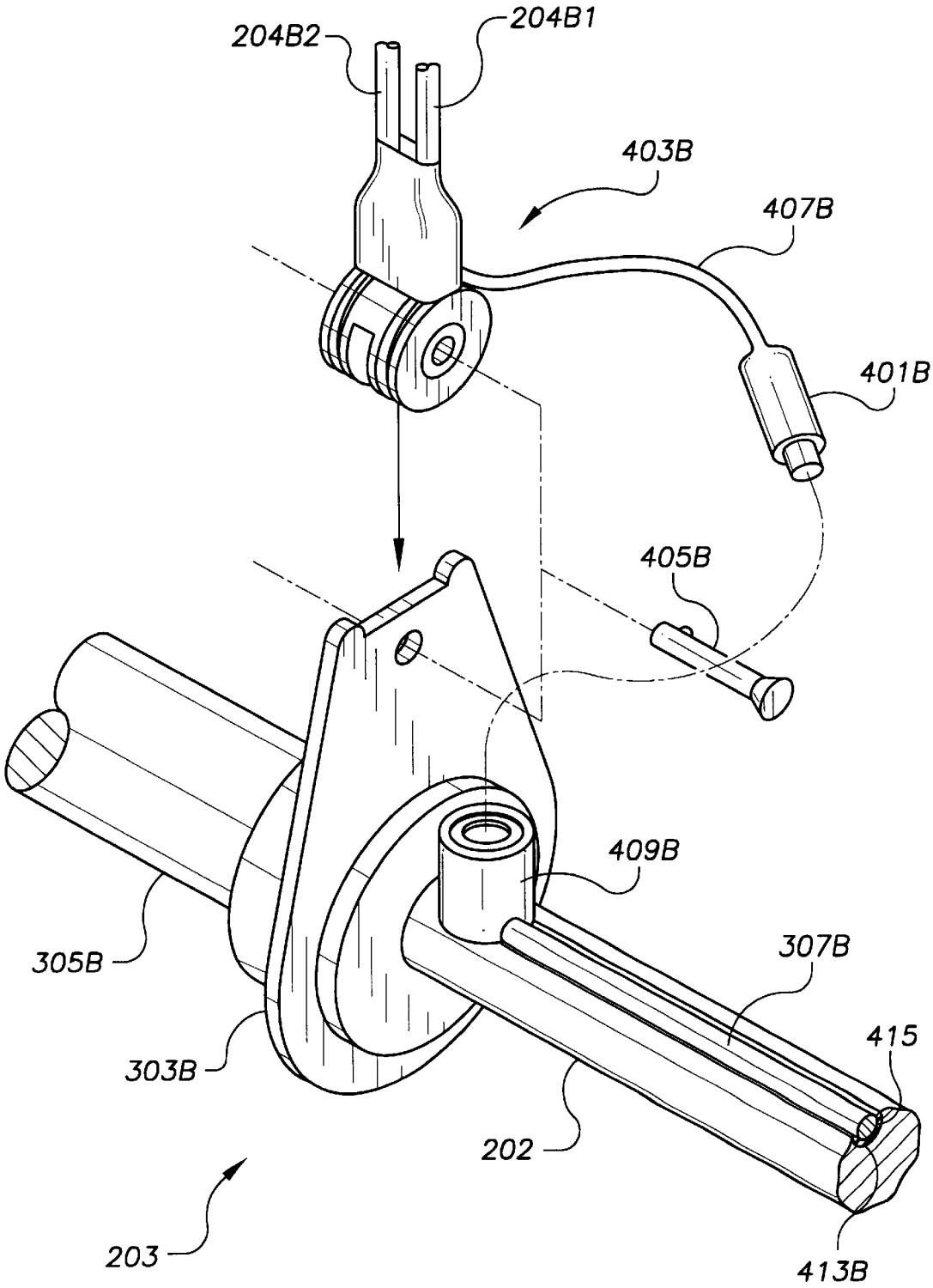
FIG. 4 is a detail perspective drawing of one of the grip sensor bars on the barbell of FIG. 2 and the connection of the grip sensor to one of the cables supporting the barbell.

FIG. 4 is a detail perspective drawing of connector 401B of cable attachment fitting 403B. Pin 405B attaches cable attachment fitting 403B to cable attachment assembly 303B for changing the barbell or for changing from barbell to dumbbells. Connector 401B electrically connects cable 204B1 to grip bar 307B via electrical cable 407B and bar connector 409B. Connector 409B is electrically connected to grip bar 307B. Grip sensor 307B acts as a capacitance electrode or sensor for the touch sensor apparatus discussed in the following figures. Only one cable is required to connect grip sensor 307B to touch sensor circuitry.

Figure 5:
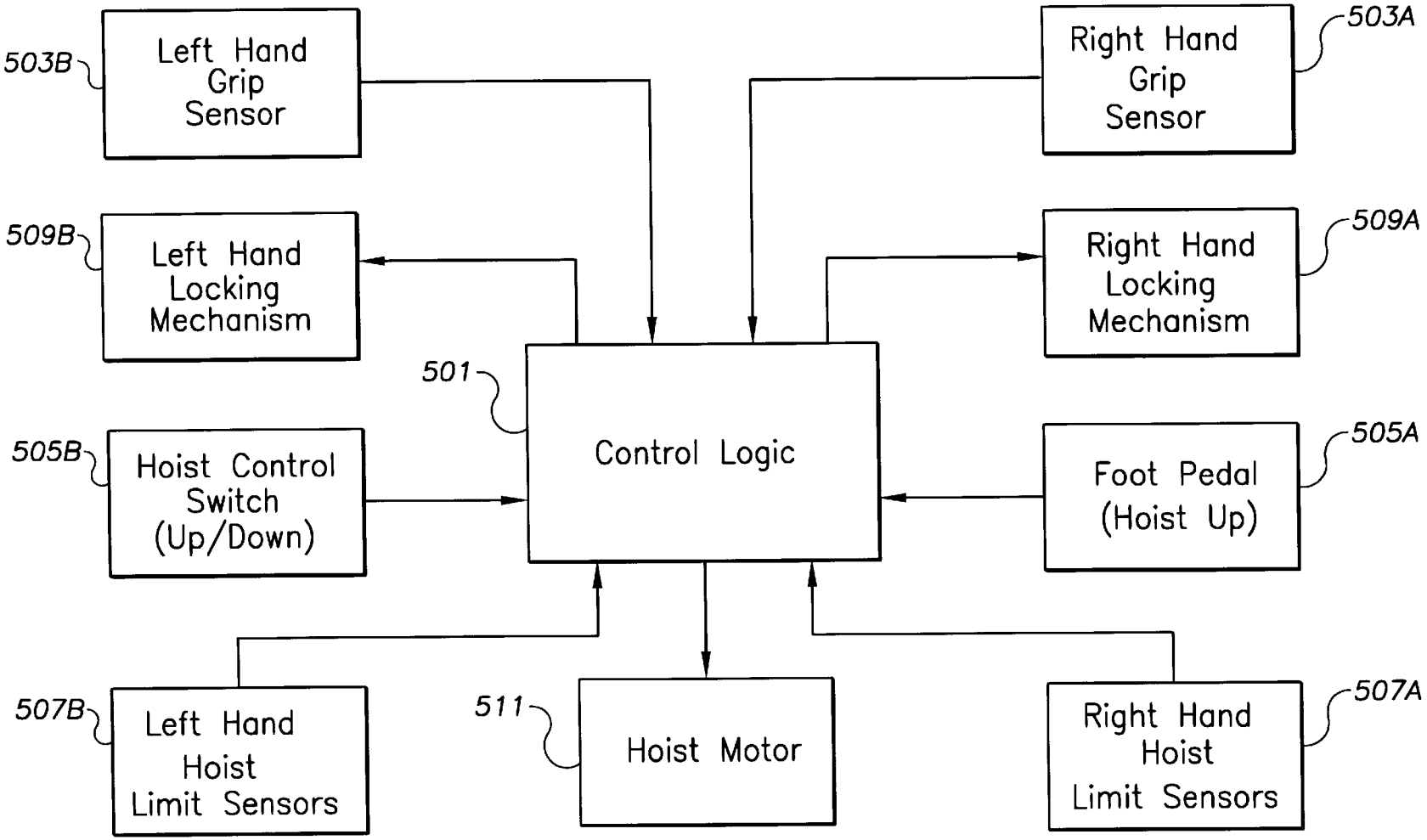
FIG. 5 is a block diagram of the interlock apparatus of the preferred embodiment showing inputs and outputs to the control logic of the apparatus.
Figure 6:
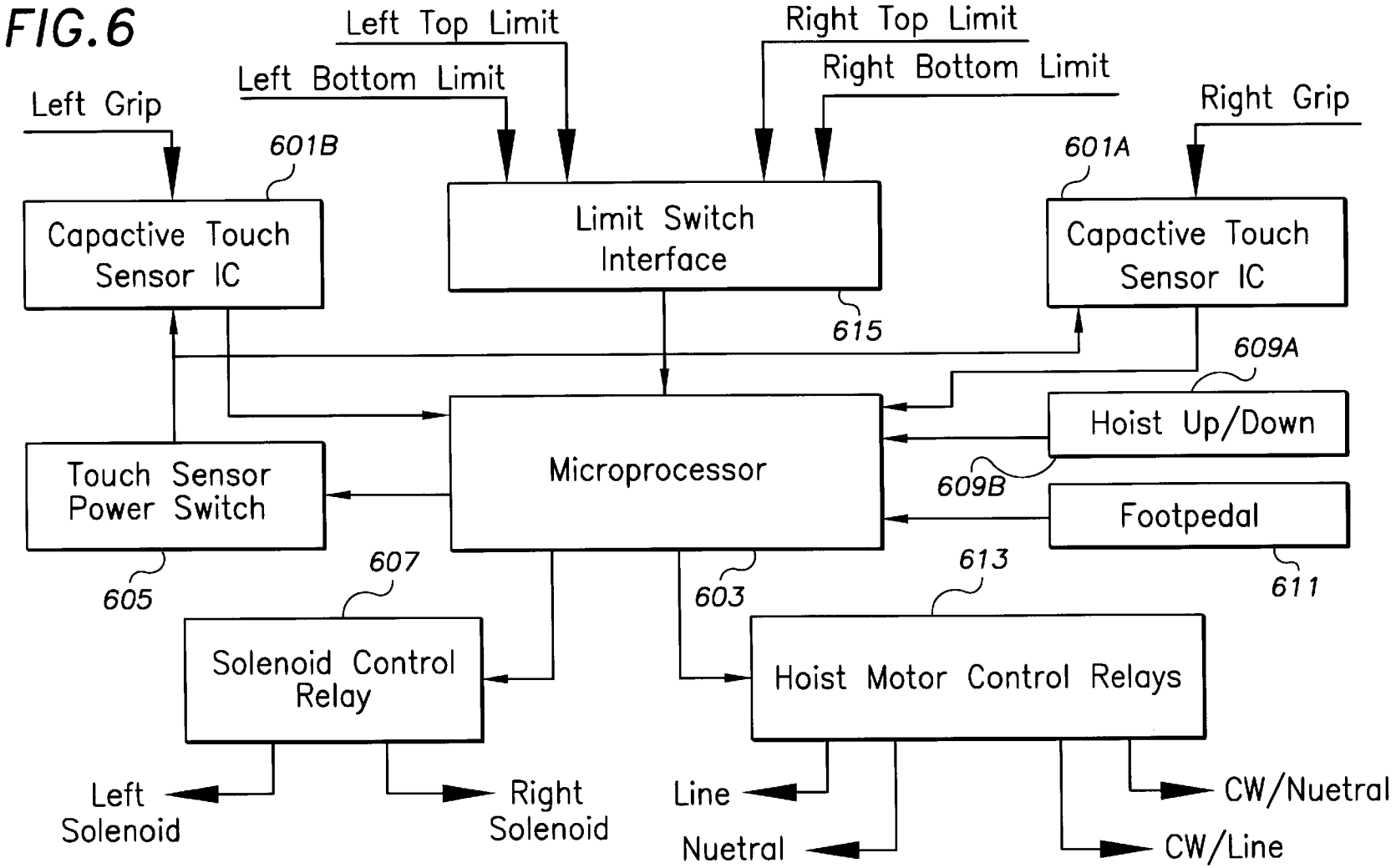
FIG. 6 is a block diagram of a microprocessor for performing the logic control functions of the apparatus and input and output interfaces of the apparatus.

Cable 204B1 is part of an electrical connection operably connecting grip sensor 307B to the touch sensor and control logic components shown in FIGS. 5 and 6. Since grip sensor 307B is a "field-sensitive" sensor such as a capacitance sensor, only one electrical connection is required from the sensor to the touch sensor circuitry. Cable 204B forms a series-connected portion of this electrical connection. In the preferred embodiments, both cables 204B1 and 204B2 are designed to take the full design mechanical loads of the equipment, although cable 204B1 is mounted so that it takes a greater portion, or all of the load, in normal operation. Should cable 204B1 fail, it opens the series-connected portion of the electrical connection to the touch sensor circuitry and is sensed the same way as a as loss of grip or disconnection of the grip sensor, thereby failing in a safe mode.

The touch sensor apparatus circuitry of the preferred embodiment is shown in FIG. 5. Control logic 501 monitors inputs from right and left hand grip sensors 503A and 503B and switch inputs 505A, 505B, 507A and 507B and based on logic algorithms applies the appropriate output signals to the locking mechanisms 509A and 509B and the hoist motor 511. The Control Logic is designed to perform the following tasks;

1. Monitor the left hand and right hand grip sensors 503A and 503B to determine when the user is touching either or both sensors.
2. Apply power to the locking mechanisms 509A and 509B in order to allow the support cables to be released when both grip sensors are activated.
3. Remove power from the locking mechanisms 509A and 509B so that the support cables lock by spring action when either or both grip sensors are deactivated.
4. Monitor the hoist up/down 505B and foot pedal 505A switch inputs to determine when they are activated.
5. Apply power to hoist motor 511 such that the support cables 204A and 204B are raised or lowered as appropriate based on input from the hoist up/down and foot pedal switches.
6. Monitor limit switch 507A and 507B inputs to determine when the hoist is at either end of its travel and prevent the motor from running in the direction of an activated limit switch.

A block diagram of the Control Logic is shown in FIG. 6. In order to detect when the user is gripping the exercise bar, a pair of capacitive touch sensors are utilized; one for the left hand (307B of FIG. 3) and one for the right hand (307A or FIG. 3). In the preferred embodiment a QT 113 charge-transfer touch sensor integrated circuits 601A and 601B (hereafter called touch sensor ICs) manufacturer by Quantum Research Group Ltd. is utilized to convert the grip sensor input into a digital signal that can be processed by the microprocessor.

Each grip sensor consists of a metallic, electrically conductive rod, approximately 0.050 inches in diameter, mounted on the exercise bar. The grip sensor rods (307A and 307B of FIG, 3) are mounted parallel to the longitudinal axis of the exercise bar. A longitudinally oriented groove (413B of FIG. 4) is machined into the surface of the exercise bar. An insulating material 415 such as plastic is inserted into groove 413 and grip sensor rod 307B is mounted into the insulation material. Insulation 415 electrically isolates grip sensor 307B from barbell bar 202 and requires hand contact with grip sensor 307B for grip actuation signals.

Ideally the sensor rod is mounted such that its entire radius extends beyond the outer surface of the exercise bar. The mounting groove is also positioned such that when the exercise bar is gripped by the user it is on the side of the bar opposite from the user's palm. This allows the user to support the exercise bar in their palm without touching (and thereby activating) the grip sensor. The user activates each grip sensor by wrapping their fingers around the bar and thereby making contact with the grip sensor rods. The left and right grip sensor rods 307A and 307B are insulated from the exercise bar and each other so that they can operate independently from one another and so that the user can support the bar without activating the grip sensors. One advantage of using this type of grip sensor is that there are no moving parts to wear out. Also, only a single wire is needed to connect the touch sensor ICs 601A and 601B to the grip sensor rod. In order to simplify the wiring and improve the system reliability, the support cables 204A1 and 204B1 are used to transfer the grip sensor signals from the exercise bar back to the control logic.

The touch sensor ICs 601A and 601B utilizes digital burst mode charge-transfer (or capacitive) sensor technology to determine when the user is touching the grip sensor. Touch sensor ICs 601A and 601B sense and monitor the grip sensor's capacitance relative to the local ground. When initially powered the touch sensor IC establishes a reference or quiescent capacitance level for the grip sensor. When the user touches the grip sensor its capacitance changes and this change in capacitance is detected by the touch sensor IC. The sensitivity of the touch sensor IC is controlled by digitally programmable inputs to the device, an external reference capacitor, and the external sensor design. The touch sensor IC circuit and grip sensor maximize the grip sensor's sensitivity while minimizing its susceptibility to external interference and manufacturing variations.

When the touch sensor IC is initially powered it calibrates itself and sets a quiescent point based on the capacitance it is measuring from the grip sensor input. When the capacitance of the grip sensor increases by a predetermined amount, the output of the touch sensor IC goes active-low. The capacitance increase which will trigger the touch sensor IC into the active state, (i.e. sensitivity) is set by the capacitance of the grip sensor, the capacitance of the external reference capacitor, and the setting of the "gain" input. The touch sensor IC utilizes a "drift compensation" algorithm which allows the device to compensate and track slow changes in the capacitance values of the grip sensor and the reference capacitor. This feature is necessary to allow the grip sensor to continue to operate properly as the capacitance of the grip sensor and reference capacitor drift due to aging and environmental changes (i.e. temperature and humidity changes).

The output of the touch sensor IC provides a "health pulse" output superimposed on the dc signal. The health pulse operates by placing the output into a tri-state (floating or high impedance) mode periodically. The period of the health pulse is determined by the relative capacitance values of the grip sensor and the reference capacitor. This health pulse can be detected by using a pull-down resistor in the quiescent mode and a pull up resistor in the active mode. The health pulse is useful in two ways. Firstly it can be monitored to confirm that the touch sensor IC is powered up and operating. In other words it can be used to distinguish between a failure of the touch sensor IC circuit that causes the output to go low erroneously and a true activation. Secondly, the period between health pulses is proportional to the relative capacitance between the grip sensor and the reference capacitor (i.e. health pulse period gives an indication of sensor amplitude or sensitivity). This period can be monitored to verify that the system is operating in a "valid" sensitivity region.

The touch sensor IC output is monitored by microprocessor 603. A Microchip PIC16C77 is utilized as the microprocessor, however one skilled in the art recognizes that there are alternative microprocessors that could be used. As can be seen in FIG. 6, the power to the touch sensor ICs can be turned on and off by microprocessor 603 through touch sensor power switch 605. This configuration allows the microprocessor to periodically cycle the power to touch sensor ICs 601A and 601B, thereby resetting them and forcing a re-calibration. There are two conditions under which we need to reset the touch sensor ICs. One condition is based on a periodic time interval. It is desirable to periodically reset the touch sensor ICs (approximately once every hour) so that it will re-initialize and recalibrate itself based on the current capacitance levels of the grip sensor and the reference capacitor. Although the touch sensor IC does perform a drift compensation algorithm as describe earlier, a forced periodic re-calibration further insures that the touch sensor ICs 601A and 601B are properly tracking any parametric drift.

The second condition under which touch sensor ICs are reset is upon detection that the grip sensor wiring has been disconnected and then reconnected. This second type of reset condition is necessary to prevent a "stuck" active condition if a grip sensor wire is connected after the touch sensor IC is powered up or if the sensor wire is disconnected and then reconnected after power up. If the touch sensor ICs 601A and 601B power up with the grip sensor wire disconnected it will calibrate itself based on the capacitance it senses in this configuration. When the grip sensor wire is then attached the capacitance will increase such that the touch sensor IC will go active low. Similarly, if after power up the grip sensor wire is disconnected, the touch sensor IC will sense a drop in capacitance. The touch sensor IC is designed to track this drop in capacitance and establish a new quiescent point. When the grip sensor wire is re-attached the touch sensor IC will detect an increase in capacitance and go active low. In both of these false activation scenarios the touch sensor IC output will stay active-low until the touch sensor IC is reset by cycling its power.

The touch sensor IC's health pulse is used to distinguish the difference between a valid activation and an activation caused by the disconnection/reconnection of the grip sensor wire. For a given reference capacitor and grip sensor topology the health pulse interval is defined by the touch sensor IC. The valid health pulse interval range for the reference capacitor and grip sensor topology being used is determined empirically and programmed into microprocessor 603. When health pulse intervals are detected outside the predetermined acceptable range, that sensor's output is invalidated or ignored. In other words if we detect that the health pulse interval is not valid then we will not consider an active-low output from the sensor as a valid indication that the user has gripped the sensor. Instead, when the active-low output from the touch sensor IC is detected, we assume that the activation is caused by a capacitance increase due to reconnection of the sensor wiring. At that point the touch sensor IC is reset by cycling its power. If the health pulse interval is subsequently in a valid range, future activations are accepted as valid. If the health pulse interval remains in an invalid range, sensor activations are ignored and touch sensor IC is reset.

When microprocessor 603 detects that the health pulse interval is valid and that the touch sensor IC output is active-low it will further qualify the activation by "de-bouncing" the active low signal. In the preferred embodiment, the touch sensor ICs 601A and 601B must be active low for approximately 100 msec before it is qualified as a valid activation. The purpose of this is to help eliminate electrical noise from potentially causing false grip sensor activations. When both grip sensors are qualified as being in the active condition (user is gripping both sensors) solenoid control relay 607 is energized. The relay 607 applies voltage to solenoid 211A of FIG. 2 mounted in the right hand 209A locking mechanisms of FIG. 2. The left side solenoid and locking mechanisms are similar. The solenoids apply force to pawls that lock the support cable in place. However, the mechanical design of the locking mechanism is such that the pawls remain in the locked position until the user lifts the bar, unloading the locking mechanism. Once the user lifts the bar, the locking force on the pawls is eliminated and the force applied by the solenoids moves the pawls out of the locked position, allowing the user to move the exercise bar freely.

Microprocessor 603 will continue to apply power to the locking mechanism solenoids until it detects that either or both grip sensors deactivate, the hoist up switch 609A closes, or the foot pedal switch 611 closes. When the power to the solenoids is removed the pawls in the locking mechanism are immediately forced back into the locked position by springs. The locking mechanism configuration is designed such that power is required to keep it unlocked. This provides a fail-safe mode if the power to the system is lost while the exercise bar is in use.

Microprocessor 603 also monitors the hoist up 609A and down 609B and foot pedal 611 switches. These switches are simple normally open contacts. When any of these switch contacts close, microprocessor 603 will de-bounce the input. If the hoist down switch 609B is closed the microprocessor will check to see if either grip sensor is active. For safety purposes, if either grip sensor is active, microprocessor 603 will not allow the exercise bar to be lowered. If neither grip sensor is active, microprocessor 603 will check the status of the limit switches at limit switch interface 615. The limit switches each contain a normally open and a normally closed mechanical switch. This allows the microprocessor to determine that each limit switch is connected, if it is operating properly, and if the locking mechanism is at the end of its travel. If the limit switches are in a valid configuration and the locking mechanism is not at the end of its downward travel (the locking mechanism travel is opposite from bar travel) microprocessor 603 turns on the appropriate hoist motor control relays 613. The microprocessor will continue to run the motor in the down direction until hoist down switch 609B is released, the left or right down limit switch 615 is activated, or either grip sensor is activated.

The hoist up 609A and foot pedal 611 switch perform the same function, causing the bar to be raised. When either of these switches are closed, microprocessor 603 will validate the limit switch inputs as discussed above, verify that the locking mechanism is not at the top limit of its travel, and then turn on the appropriate hoist motor control relays to cause to exercise bar to be raised. The locking solenoids must be de-energized in order for the exercise bar to be lifted by positioner 205 of FIG. 2. Therefore, if the grip sensors are active and the locking solenoids are energized when either the hoist up or foot pedal switches are activated, microprocessor 603 will de-energize the locking solenoids so that the exercise bar can be lifted. The hoist up and foot pedal switches take priority over the grip sensor inputs. This is done to insure that the exercise bar can be raised even if the user panics and forgets to lift their fingers off of the grip sensor.

Accordingly, the reader will see the interlock apparatus for fitness equipment provides enhanced convenience and safety functions for a wide variety of applications. The device provides the following additional advantages:

There are no moving parts required in the grip sensors;

Only one electrical signal to the control logic apparatus is required;

The signal status monitor provides the ability to validate grip sensor signals;

The microprocessor simplifies weight equipment modifications by recognizing disconnections and re-connections of the sensors and makes appropriate changes; and Connections to the sensors are simplified and safety enhanced by utilizing support cables as sensor connections.

Although the description above contains many specifications, these should not be construed as limiting the scope of the invention but merely providing illustrations of some of the presently preferred embodiments of this invention. For example, the apparatus of the present invention may include a grip sensor sensing engagement of a user's foot to a contact-sensing foot pedal of a load-bearing component of fitness equipment. The grip status signal may be used in the validity criteria of the logic processor to determine the adequacy of the user's grip on the load-bearing component. The grip sensors may be switches and the grip sensor status monitor may be a continuity-sensing device to sense continuity of the grip sensors to the apparatus circuitry. Or, the signal conditioning and logic processing functions may be combined into a single component. Thus the scope of the invention should be determined by the appended claims and their legal equivalents, rather than by the examples given.

We claim:

1. A grip interlock apparatus for providing an actuation signal representative of a user engaging a load-bearing component of fitness equipment, the apparatus comprising:

a logic processor;

a grip sensor attachable to the load-bearing component of the fitness equipment, the grip sensor in communication with the logic processor and providing a grip signal upon the user engaging the load-bearing component; and a grip signal status monitor in communication with the grip sensor and the logic processor, the grip signal status monitor providing a grip status signal representative of a validity condition of the grip signal;

the logic processor comprising a first predetermined validity criteria to provide the actuation signal upon the grip signal from the grip sensor meeting the first predetermined validity criteria; wherein the first predetermined validity criteria is changed to a second predetermined validity criteria by the logic processor upon receipt of a change in the grip status signal from the grip signal status monitor.

2. The interlock apparatus of claim 1 wherein the change in grip status signal is related to the amplitude of the grip signal.

3. The interlock apparatus of claim 1 wherein the change in grip status signal is related to a cardiovascular pulse.

4. The interlock apparatus of claim 1 wherein the change in grip status signal is related a continuity of connection of the grip sensor to the apparatus.

5. The interlock apparatus of claim 1 wherein the grip signal status monitor is a signal conditioner communicating the grip signal from the grip sensor to the logic processor.

6. The interlock apparatus of claim 5 wherein the signal conditioner provides a grip status signal related to the amplitude of the grip signal.

7. The interlock apparatus of claim 1 wherein the second predetermined validity criteria ignores a subsequent grip signal from the grip sensor.

8. The interlock apparatus of claim 6 wherein the logic processor recalibrates the signal conditioner upon receipt of a change in the grip status signal.

9. The interlock apparatus of claim 1 comprising a second grip sensor and wherein the logic processor requires a second grip signal from the second grip sensor in order to provide the actuation signal.

10. The interlock apparatus of claim 1 wherein grip sensor is a capacitance sensor.

11. The interlock apparatus of claim 1 wherein the grip sensor is a conductance sensor.

12. The interlock apparatus of claim 1 wherein the grip sensor is an inductance sensor.

13. The interlock apparatus of claim 1 wherein the grip sensor is a switch.

14. A grip interlock apparatus for providing an actuation signal representative of a user engaging a load-bearing component of fitness equipment, the apparatus comprising:

a logic processor;

a grip sensor attachable to the load-bearing component of the fitness equipment providing a grip signal to the logic processor upon engagement of the grip sensor by the user;

a grip signal status monitor providing a grip status signal related to the amplitude of the grip signal to the logic processor;

the logic processor comprising a first validity criteria for providing the actuation signal, the first validity criteria requiring an active grip signal when a first predetermined grip status signal is received, and a second validity criteria for providing the actuation signal, the second validity criteria adding at least one logic step to the first validity criteria when a second predetermined grip status signal is received.

15. The interlock apparatus of claim 14 wherein said at least one logic step comprises ignoring a subsequent active grip signal in the presence of the first predetermined sensor status signal if a second predetermined grip status signal is received prior to said subsequent active grip signal.

16. The interlock apparatus of claim 14 wherein the apparatus comprises a signal conditioner communicating with the grip sensor and the logic processor and said at least one logic step includes recalibration of the signal conditioner.

17. A grip interlock apparatus for providing an actuation signal representative of a user engaging a load-bearing component of fitness equipment, the apparatus comprising:

a logic processor; and a first capacitance sensor attached to the load-bearing component of the fitness equipment, the first capacitance sensor providing a first grip signal when the user operably engages the load-bearing component;

the first capacitance sensor communicating with the logic processor by a first cable supporting the load-bearing component;

wherein the first cable provides at least part of a capacitance connection for the first grip signal to the logic processor.

18. The grip interlock apparatus of claim 17 wherein the first capacitance sensor comprises an electrical conductor attached to, and electrically insulated from, the weight-bearing component of the fitness equipment.

19. The grip interlock apparatus of claim 18 wherein the weight-bearing component is a free-weight bar.

20. The grip interlock apparatus of claim 17 comprising a second capacitance sensor attached to the load-bearing component of the fitness equipment, the second capacitance sensor providing a second grip signal when the user operably engages the load-bearing component and the second capacitance sensor communicating with the logic processor by a second cable supporting the load-bearing component;

the logic processor requiring the first grip signal and the second grip signal to provide the actuation signal.

21. A grip sensor apparatus for providing an actuation signal representative of a user engaging a load-bearing component of fitness equipment, the apparatus comprising:

a field-sensitive sensor attached to the load-bearing component of the fitness equipment, the field-sensitive sensor providing a grip signal when the user engages the load-bearing component;

a signal conditioner disposed on a predetermined control component location of the fitness equipment; and an electrically conductive cable providing a series-connected portion of a first electrical connection operably connecting the field-sensitive sensor to the signal conditioner, the electrically conductive cable supporting the load-bearing component.

22. The grip sensor apparatus of claim 21 wherein the electrically conductive cable is functionally a single-conductor cable.

23. The grip sensor apparatus of claim 21 wherein the field-sensitive sensor is a capacitance sensor.

24. The grip sensor apparatus of claim 21 wherein the field-sensitive sensor is an inductance sensor.

25. The grip sensor apparatus of claim 21 wherein the field-sensitive sensor consists of an electrode mounted on the load-bearing component.

26. A touch-sensitive apparatus for fitness equipment comprising:

a load-bearing component for the fitness equipment, the load-bearing component operably engageable by a user; and a field-sensitive touch sensor disposed on the load-bearing component, the touch sensor providing an engagement signal for processing by control apparatus on the fitness equipment when the touch sensor is in touch contact by the user.

27. The touch sensor apparatus of claim 26 wherein the field-sensitive touch sensor is an electrode for sensing capacitance.

28. The touch sensor apparatus of claim 26 wherein the field-sensitive touch sensor is an electrode electrically insulated from the load-bearing component.

29. The touch sensor apparatus of claim 28 wherein the electrode comprises a single electrical connection which is sufficient for operably connecting the touch sensor to the control apparatus.

30. The touch sensor apparatus of claim 29 wherein the single electrical connection comprises a cable supporting the load-bearing component.

* * * * *